US009046875B2

(12) United States Patent
Hiranuma et al.

(10) Patent No.: US 9,046,875 B2
(45) Date of Patent: Jun. 2, 2015

(54) PORTABLE APPARATUS AND PORTABLE TIMEPIECE

(71) Applicant: Seiko Instruments Inc., Chiba-shi, Chiba (JP)

(72) Inventors: Haruki Hiranuma, Chiba (JP); Masahiro Ishida, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 14/453,257

(22) Filed: Aug. 6, 2014

(65) Prior Publication Data

US 2015/0043314 A1 Feb. 12, 2015

(30) Foreign Application Priority Data

Aug. 12, 2013 (JP) ..... 2013-167908

(51) Int. Cl.

| | |
|---|---|
| ***G04B 3/04*** | (2006.01) |
| ***G04B 37/10*** | (2006.01) |
| ***G04C 3/00*** | (2006.01) |
| ***H01H 3/12*** | (2006.01) |

(52) U.S. Cl.

CPC ..... *G04B 3/048* (2013.01); *G04C 3/001* (2013.01); *H01H 3/12* (2013.01); *G04B 37/106* (2013.01)

(58) Field of Classification Search

CPC ..... G04B 3/046; G04B 3/048; G04B 37/106; G04C 3/001; H01H 3/12

USPC ..... 368/288–290, 308, 319–321

See application file for complete search history.

(56) References Cited

U.S. PATENT DOCUMENTS

| | | | | |
|---|---|---|---|---|
| 3,362,154 | A * | 1/1968 | Perret | 368/290 |
| 4,430,532 | A * | 2/1984 | Matsumoto | 200/52 R |
| 7,387,434 | B2 * | 6/2008 | Hiranuma et al. | 368/319 |
| 7,556,422 | B2 * | 7/2009 | Cretin et al. | 368/290 |
| 2005/0094498 | A1 * | 5/2005 | Koshoji et al. | 368/319 |
| 2006/0158967 | A1 * | 7/2006 | Hiranuma et al. | 368/318 |
| 2006/0187766 | A1 * | 8/2006 | Hiranuma et al. | 368/319 |

FOREIGN PATENT DOCUMENTS

| | | |
|---|---|---|
| JP | 2003-007164 A | 1/2003 |

* cited by examiner

*Primary Examiner* — Vit W Miska
(74) *Attorney, Agent, or Firm* — Brinks Gilson & Lione

(57) ABSTRACT

Provision of a portable apparatus which is of a simple construction and which can prevent a lock member arranged at a lock position where a pushbutton is locked from being erroneously rotated to an excessive degree. A pipe inserted into a through-hole of an apparatus exterior body is fixed to the apparatus exterior body. The pipe consists of a single component, and has a male screw portion and a stopper portion on an external arrangement tube portion thereof. A lock member is provided with a female screw portion, a lock part, and a lock portion configured to move toward and away from the stopper portion. The two screw portions and are threadedly engaged with each other, and the lock member is mounted so as to be movable in the axial direction of the pipe. A shaft portion of a pushbutton is passed through the pipe, and the pushbutton is urged toward the exterior of the apparatus exterior body by a spring. A head with which the pushbutton is equipped has an opposing portion facing the lock part. A retaining ring is mounted to a shaft end portion of the shaft portion situated inside the apparatus exterior body, and the pushbutton is prevented from being detached from the pipe.

8 Claims, 10 Drawing Sheets

PORTABLE APPARATUS AND PORTABLE TIMEPIECE

RELATED APPLICATIONS

This application claims priority under 35 U.S.C. §119 to Japanese Patent Application No. 2013-167908 filed on Aug. 12, 2013, the entire content of which is hereby incorporated by reference.

BACKGROUND OF THE INVENTION

1. Field of the Invention

The present invention relates to a portable apparatus and a portable timepiece equipped with a pushbutton switch.

2. Description of the Related Art

Some portable apparatuses such as a portable timepiece, for example, a wristwatch or a pocket watch, a stopwatch, a mobile phone, and a personal digital assistant have, mounted on the apparatus exterior body, a pushbutton for operating, for example, a contact in the apparatus exterior body. In the case, for example, of a portable timepiece, by pushing in the pushbutton by a predetermined stroke, it is possible to switch the illumination of the dial or the timepiece display from analog to digital display or vice versa, or to correct the date or the day of the week digital-displayed.

In a portable apparatus of this type, the pushbutton is urged by a spring in a direction reverse to the pushing-in direction thereof, so that detachment of the pushbutton from a pipe due to this spring force is prevented. For this purpose, a C-type or E-type retaining ring configured to be get caught by an end of the pipe is provided at an end portion of the pushbutton reaching the interior of the apparatus exterior body through the pipe fixed to the apparatus exterior body.

In view of this construction, the conventional portable apparatus is equipped with a lock member for preventing erroneous operation of the pushbutton. The lock member has a female screw portion formed in the inner periphery thereof, which is threadedly engaged with a male screw portion formed on the outer periphery of the pipe fixed to the apparatus exterior body, and is provided so as to be movable between a lock position and a non-lock position through a change in the mesh-engagement between these screw portions (See, for example, JP-A-2003-7164 (Patent Literature 1)).

In this construction, when the lock member is moved to the non-lock position, the lock member is detached from the head of the pushbutton having passed through the pipe. Thus, the pushing-in operation of the pushbutton is allowed by a stroke corresponding to the detachment distance. Conversely, when the lock member is moved to the lock position, the lock member is brought into contact with the head of the pushbutton. As a result, the pushing-in of the pushbutton is prevented.

In the prior-art technique, the retaining ring mounted to the pushbutton is caught by an end of the pipe inside the apparatus exterior body, whereby the pushbutton is set in position; and the lock member moved to the lock position is brought into contact with the head of the pushbutton in this state. Thus, even in the state in which the pushbutton is locked, the mesh-engagement state between the male screw portion and the female screw portion is maintained.

Substantially to the reaching of the lock position by the lock member, it may occur that the lock member having the female screw portion or a rotary ring is erroneously rotated to an excessive degree by the operator.

Such an erroneous operation is possible for the following reason. That is, the strength of the retaining ring is not so great, and the elastic deformation of the retaining ring is relatively easy; further, the retaining ring has a notch, so that it is capable of deformation so as to be reduced in diameter. Thus, due to the elastic deformation of the retaining ring, it is rather difficult for the user to sense that the lock member has reached the lock position. Owing to this, it can happen that the lock member or the rotary ring is erroneously operated as described above.

When the lock member or the rotary ring is erroneously rotated to an excessive degree, it can happen, as a result thereof, that the deformed retaining ring is drawn into the pipe. As a result, there is a fear of a smooth axial movement of the pushbutton after the erroneous operation being hindered. In particular, when, in order to improve operability, the lock member or the rotary ring is designed in a larger diameter, the rotational torque due to the erroneous operation mentioned above is augmented. As a result, the retaining ring becomes easier to deform, and there is high possibility of the retaining ring being drawn into the pipe. Furthermore, the problem due to the above-mentioned erroneous operation constitutes a hindrance factor to designing the lock member or the rotary ring in a larger outer diameter.

It might be possible to cope with the above-mentioned problem by increasing the wall thickness of the retaining ring or forming the retaining ring of a high-strength material so as to make it harder for the retaining ring to undergo deformation. This, however, requires a dedicated retaining ring to be newly developed, resulting in an increase in cost. In addition, the operation of attachment/detachment of the retaining ring to/from the shaft portion of the pushbutton is a bother, resulting in great deterioration in workability when the components around the pushbutton are dismantled for cleaning. Thus, the above measure is not desirable.

And, in avoiding generation of a problem due to the above erroneous operation, it is desirable to suppress an increase in cost. For this purpose, it is desirable to avoid an increase in the number of components as far as possible, and to make the component structure as simple as possible. When these conditions are satisfied, the assembly and the component machining are facilitated, and it is possible to suppress an increase in cost.

SUMMARY OF THE INVENTION

It is an object of the present invention to provide a portable apparatus and a portable timepiece which are of a simple construction and yet which help to prevent the lock member from being erroneously operated to an excessive degree in the state in which it has been moved to the lock position where the pushing-in of the pushbutton is hindered.

To achieve the above object, there is provided, according to the present invention, a portable apparatus including: an apparatus exterior body having a through-hole; a pipe consisting of a single component equipped with an insertion tube portion fixed to the apparatus exterior body by being inserted to the through-hole, an external arrangement tube portion arranged outside the apparatus exterior body so as to be continuous with this insertion tube portion and having a stopper portion, and a male screw portion formed on this external arrangement tube portion; a lock member equipped with a female screw portion, a lock part, and a lock portion configured to move toward and away from the stopper portion, and mounted through threaded engagement of the female screw portion with the male screw portion so as to be movable in the axial direction of the pipe; a pushbutton equipped with a shaft portion extending through the pipe so as to be axially movable, and a head situated outside the apparatus exterior body so as to be continuous with this shaft portion and having an opposing portion opposite the lock part; a spring urging this pushbutton toward the exterior of the apparatus exterior body; and a retaining ring mounted to a shaft end portion of the shaft portion situated inside the apparatus exterior body and configured to prevent detachment of the pushbutton from the pipe.

The portable apparatus according to the present invention is applicable to a portable timepiece such as a wristwatch or a pocket watch, a stopwatch, a mobile phone, a personal digital assistant, etc., and the apparatus exterior body thereof means an exterior case or the like. In the present invention, it is desirable for the opposing portion of the head of the pushbutton to utilize an end surface on the back side of the head; however, it is also possible for the opposing portion to be something other than a surface. In the present invention, it is possible to use as the retaining ring a C-type or an E-type retaining ring.

In the present invention, when it is said that the spring urges the pushbutton toward the exterior of the apparatus exterior body, it means that the spring urges the pushbutton upwards in the case where the pushbutton is provided so as to be pushed in from the front side of the apparatus exterior body; and, in the case where the pushbutton is pushed in from a side surface of the apparatus exterior body, it means that the spring urges the pushbutton outwardly sidewise.

The lock member of the portable apparatus of the present invention is rotated by an operator such as the user. Through this operation, the mesh-engagement between the male screw portion of the pipe fixed to the apparatus exterior body and the female screw portion of the lock member undergoes a change, and, with this change, the lock member moves between a non-lock position and a lock position. The lock member arranged at the non-lock position allows the pushing-in operation of the pushbutton. The lock member arranged at the lock position constrains the movement of the pushbutton so that the pushing-in operation cannot be performed on the pushbutton.

That is, in the state in which the lock member has been moved to the lock position through rotational operation, the lock portion of the lock member is spaced away from the stopper portion integral with the pipe. At the same time, in the same state, the lock part of the lock member is spaced away from the opposing portion of the head of the pushbutton. Thus, it is possible to push in the pushbutton. When the pushbutton is pushed in, it is possible, by the shaft portion thereof, to operate a button response member such as a contact arranged inside the apparatus exterior body.

In the state in which the lock member has been moved to the lock position through rotational, operation, the lock part of the lock member is in close proximity to or in contact with the opposing portion of the head of the pushbutton. As a result, the lock part serves as a stopper, and the pushbutton is retained so as not to be pushed in.

At the same time, in the state in which the lock member has been moved to the lock position, the lock portion of the lock member is in contact with the stopper portion of the pipe. Since the insertion tube portion of the pipe is fixed to the apparatus exterior body, the lock member is maintained in the state in which it is set in position on the apparatus exterior body so that the lock member may not further move away from the apparatus exterior body due to the contact (engagement) between the lock portion and the stopper portion.

As a result, even if an attempt is made by the operator or the like to further rotate the lock member moved to the lock position, it is possible to prevent the lock member from being excessively rotated in the wrong direction. That is, erroneous operation of the lock member moved to the lock position is prevented, and, as a result of that, an excessive load is prevented from being applied to the retaining ring.

In this case, even if it is somewhat possible for the lock member to rotate based on the mesh-engagement at the threaded-engagement portion between the female screw portion and the male screw portion, the force which strives to move the lock member at that time is supported by the apparatus exterior body via the pipe. As a result, it is possible to prevent the opposing portion of the pushbutton from being strongly pushed so as to be detached from the apparatus exterior body.

Further, the pipe having a stopper portion retaining the lock member at the lock position is not formed through combination of a plurality of members; it is a single component. Thus, there is no need for time and effort or structure for attaching the stopper, prepared separately from the pipe, to the pipe. As a result, the requisite number of components and assembly man-hours are small, and the construction is simple, which helps to achieve a reduction in cost.

Thus, in the portable apparatus of the present invention, it is possible to prevent, with a simple construction, an excessive load from being applied to the retaining ring via the pushbutton, and, with that, it is possible to eliminate the fear of the retaining ring being deformed and drawn into the pipe.

In a preferred mode of the present invention, there is provided a portable apparatus, wherein the external arrangement tube portion is equipped with a large-diameter tube portion having the stopper portion and the male screw portion, and a small-diameter tube portion of a smaller diameter than this large-diameter tube portion and extending between the insertion tube portion and the large-diameter tube portion; the stopper portion is formed by a step formed by the large-diameter tube portion and the small-diameter tube portion; and the lock portion is formed by an end wall of the lock member having a hole of a larger diameter than the small-diameter tube portion and of a smaller diameter than the large-diameter tube portion.

In this preferred mode, in the state in which the lock member has been moved to the lock position, the lock portion formed by the end wall of the lock member is caught by the stopper portion formed by the step formed by the large-diameter portion and the small-diameter portion of the pipe. As a result, this lock member is retained in position on the apparatus exterior body so as not to be detached from the apparatus exterior body. Thus, even if the lock member arranged at the lock position is rotated in the wrong direction, it is possible to prevent the opposing portion of the pushbutton from being strongly pushed by the lock part of the lock member so as to be detached from the apparatus exterior body. Thus, it is possible, with a simple construction, to eliminate the fear of the retaining ring from being deformed and drawn into the pipe.

In a preferred mode of the present invention, there is provided a portable apparatus, wherein the external arrangement tube portion is equipped with a large-diameter tube portion having the stopper portion and the male screw portion, and a small-diameter tube portion of a smaller diameter than this large-diameter tube portion and extending between the insertion tube portion and the large-diameter tube portion; the male screw portion is formed on the large-diameter tube portion so as to be continuous with the step formed by the large-diameter tube portion and the small-diameter tube portion; the stopper portion is formed by an incomplete screw portion spaced away from the step of the male screw portion; and the lock portion is formed by an end of the female screw portion continuous with the lock part.

In this preferred mode, in the state in which the lock member has been, moved to the lock position, the lock portion formed by an end of the female screw portion of the lock member is held in contact with the stopper portion formed by the incomplete screw portion of the male screw portion of the large-diameter tube portion of the pipe. As a result, the lock member is retained in position on the apparatus exterior body so as not to be detached from the apparatus exterior body. Thus, even if the lock member arranged at the lock position is rotated in the wrong direction, it is possible to prevent the opposing portion of the pushbutton from being strongly pushed by the lock part of the lock member so as to be detached from the apparatus exterior body. Thus, it is possible, with a simple construction, to eliminate the fear of the retaining ring from being deformed and drawn into the pipe.

In a preferred mode of the present invention, there is provided a portable apparatus, wherein the small-diameter tube portion is of a larger diameter than the insertion tube portion; and the step portion formed by the small-diameter tube portion and the insertion tube portion is held in contact with a bottom surface of a recess formed in the apparatus exterior body so as to be open to the exterior of the exterior body.

In this preferred mode, the step portion of the pipe fixed to the apparatus exterior body and the bottom surface of the recess of the apparatus exterior body are held in contact with each other, whereby the pipe inserted into the through-hole of the apparatus exterior body for fixation can be set in position in the axial direction with respect to the apparatus exterior body. As a result, the stopper portion and the large-diameter tube portion having the male screw portion is arranged at a proper position with respect to the bottom surface of the recess, so that it is easy to control the stroke of the lock member between the lock position and the non-lock position.

In a preferred mode of the present invention, there is provided a portable apparatus, wherein the lock member has a small-diameter tube portion having the female screw portion formed in its inner periphery, a large-diameter tube portion of a larger diameter than the small-diameter tube portion and covering the outer periphery of the head, and the bottom wall integrally connecting the large-diameter tube portion and the small-diameter tube portion to form the recess together with the large-diameter tube portion; and a seal ring is provided between the large-diameter tube portion and the head.

In this preferred mode, when the operator rotates the lock member and when he pushes in the pushbutton, the operator can experience an adequate operational feel due to the sliding resistance of the seal ring. At the same time, it is possible to suppress, by virtue of the seal ring, intrusion of foreign matter such as grains of sand through a gap between the large-diameter tube portion of the lock member and the outer periphery of the head.

To achieve the above object, there is provided, according to the present invention, a portable timepiece formed by a portable apparatus according to one of the above aspects of the invention.

According to the present invention, a portable timepiece is formed by a portable apparatus according to one of the above aspects of the invention, so that it is possible to provide a portable timepiece in which it is possible, with a simple construction, to prevent the lock member from being erroneously rotated to an excessive degree in the state in which the lock member has been moved to the lock position where the pushing-in of the pushbutton is hindered.

According to the present invention, it is possible to provide a portable timepiece and a portable timepiece in which it is possible, with a simple construction, to prevent the lock member from being erroneously rotated to an excessive degree in the state in which the lock member has been moved to the lock position where the pushing-in of the pushbutton is hindered.

BRIEF DESCRIPTION OF THE DRAWINGS

FIG. 2 is a perspective view illustrating the wristwatch of FIG. 1 in a state in which a pushbutton constituting a part thereof can be pushed in.

FIG. 3 is a perspective view illustrating the wristwatch of FIG. 1 in a state in which a pushbutton constituting a part thereof is prevented from being pushed in.

FIG. 4 is a sectional view, taken along the arrow line F-F of FIG. 1, illustrating the wristwatch of FIG. 1 in a state in which a pushbutton with which it is provided can be pushed in.

FIG. 5 is a sectional view, taken along the arrow line F-F of FIG. 1, illustrating the wristwatch of FIG. 1 in a state in which a pushbutton with which it is provided is prevented from being pushed in.

DETAILED DESCRIPTION OF THE PREFERRED EMBODIMENTS

Figure 1:
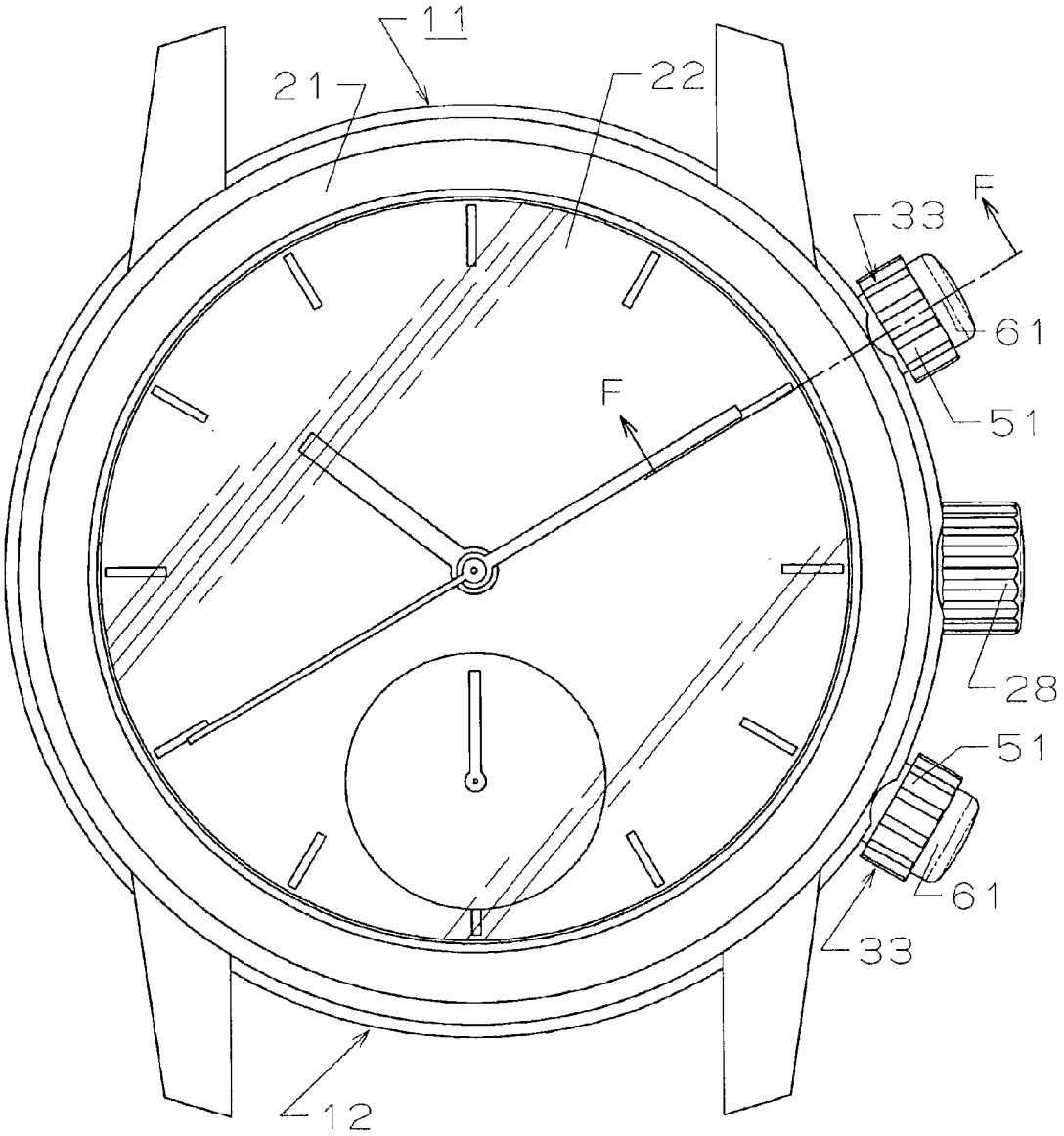
FIG. 1 is a front view of a wristwatch according to a first embodiment of the present invention.

The first embodiment of the present invention will be described with reference to FIGS. 1 through 6.

In FIGS. 1 through 5, numeral 11 indicates a portable apparatus, for example, a portable timepiece, and, more specifically, a wristwatch used as a waterproof timepiece. The wristwatch 11 is equipped with an apparatus exterior body, e.g., a timepiece exterior body 12.

Figure 4:
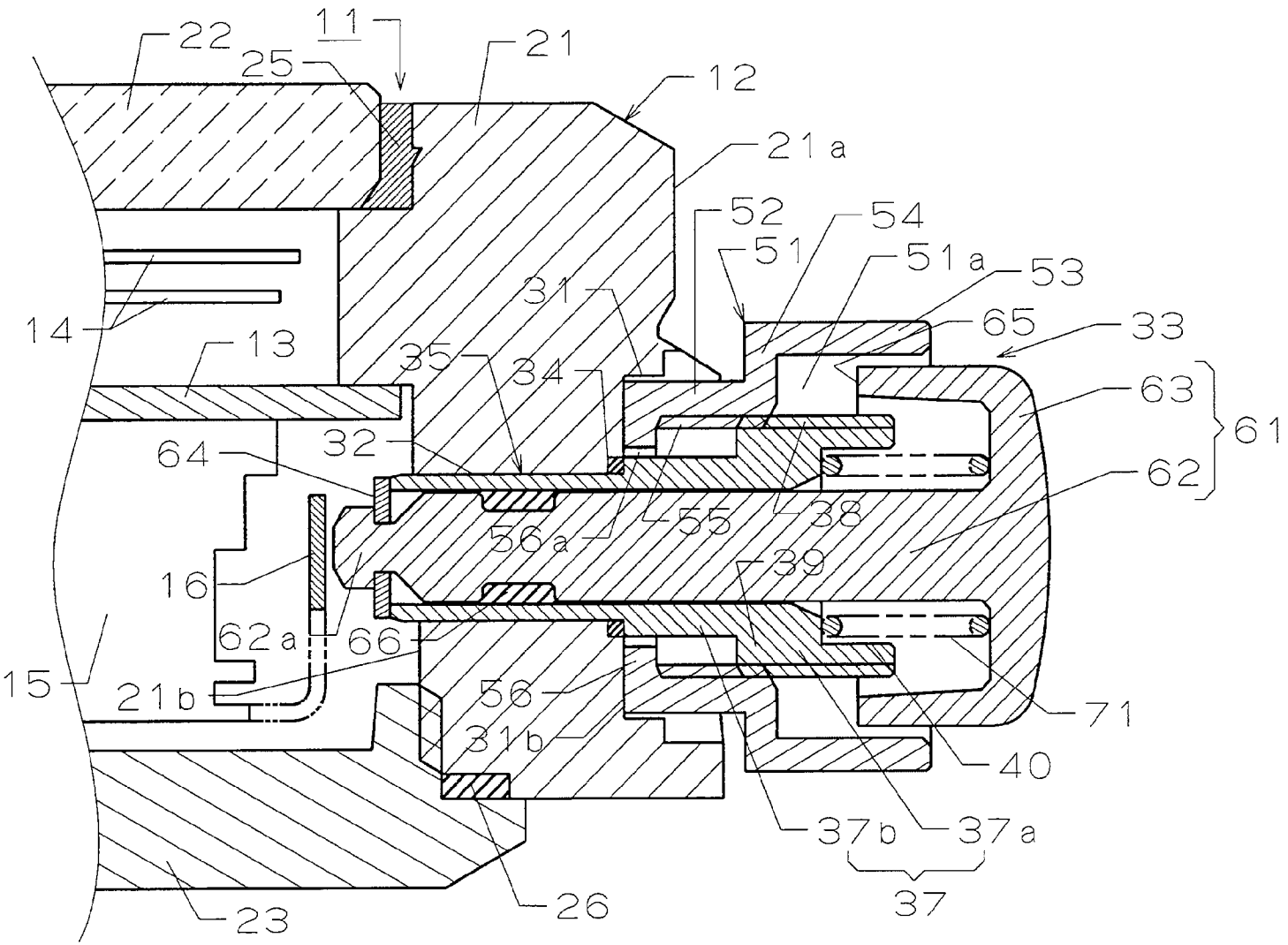
Figure 5:
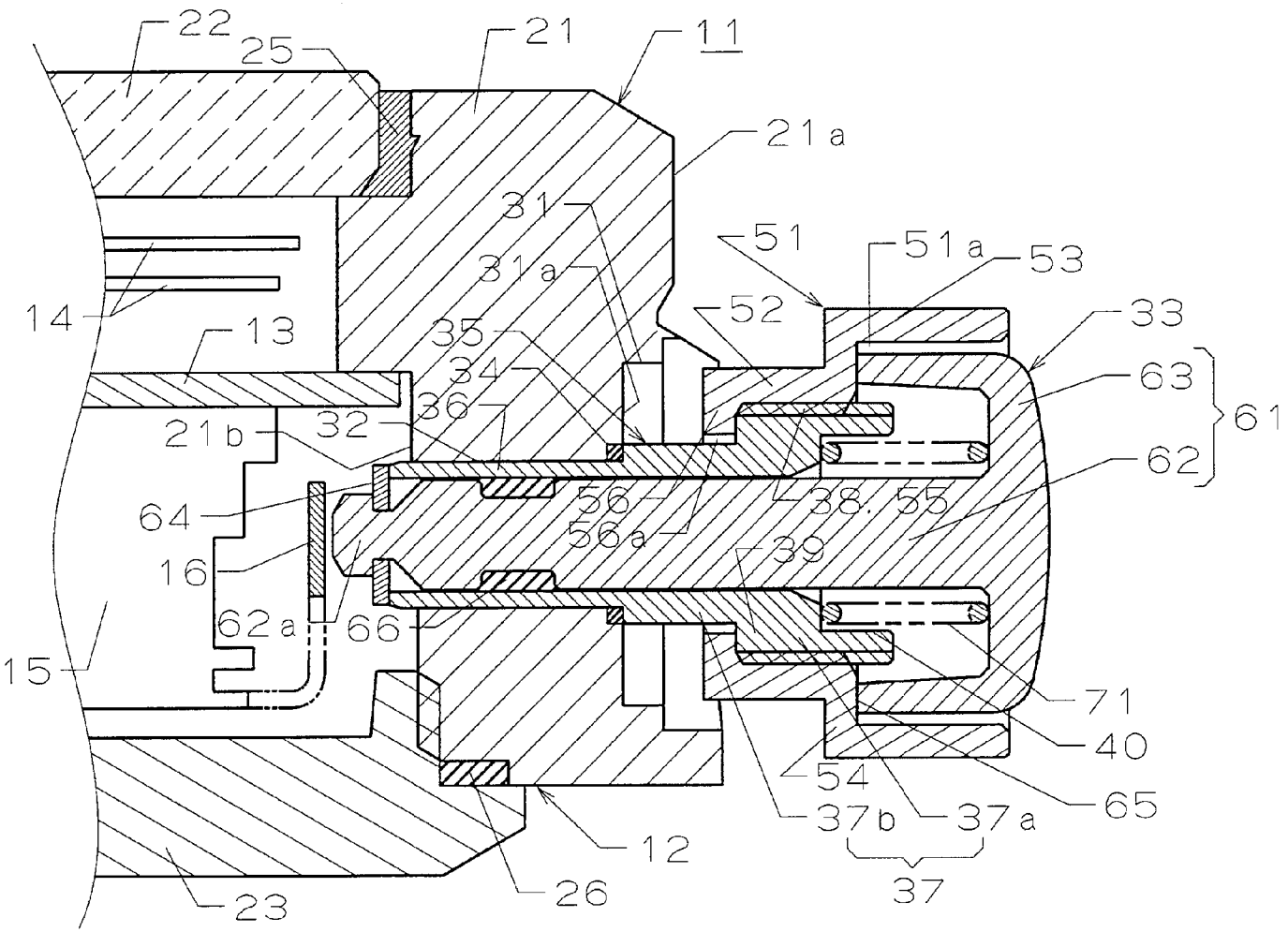

As shown in FIGS. 4 and 5, the timepiece exterior body 12 accommodates the requisite members including a display plate such as a dial 13, an apparatus for controlling display, e.g., a movement 15 configured to control the movement of a hand 14 for indicating hour, a lamp (not shown), and a battery (not shown) as the power source.

The movement 15 has at least one, for example, two (FIGS. 4 and 5 respectively show one of them) button response members such as contacts 16. These contacts 16 are formed of plate springs or the like and protrude from the outer periphery of the movement 15. The contacts 16 are depressed by pushbuttons 61 described below, whereby the movement 15 etc. exerts a function allotted to each of the pushbuttons 61. For example, the lower right-hand side pushbutton 61 in FIG. 1 has a function to start and stop time measurement, and the upper right-hand side pushbutton 61 in FIG. 1 has a function to light and extinguish a lamp.

As shown in FIGS. 4 and 5, the timepiece exterior body 12 has a body 21 formed in an annular configuration of a metal such as stainless steel or titanium, and a cover glass 22 making a dial 13 visible is attached to the front surface of the body 21 in a liquid-tight fashion; at the same time, a case back 23 formed of metal, synthetic resin or the like is attached to the back surface of the body 21 in a liquid-tight fashion.

Figure 2:
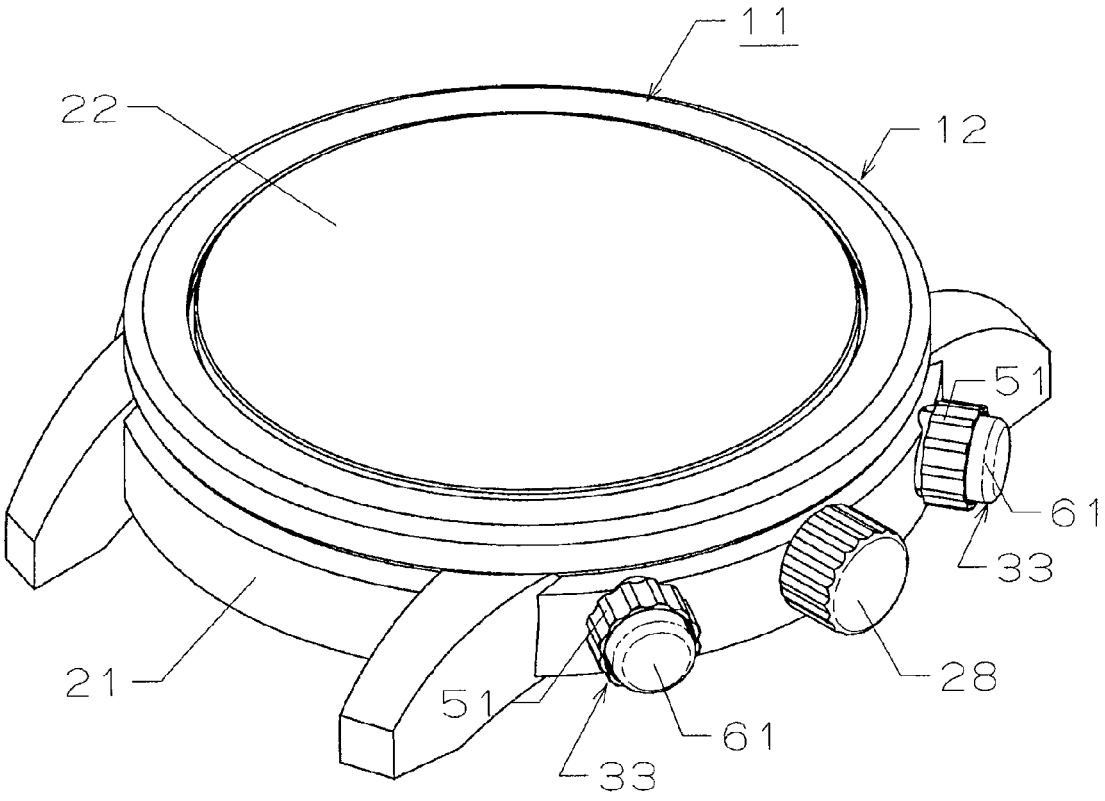
Figure 3:
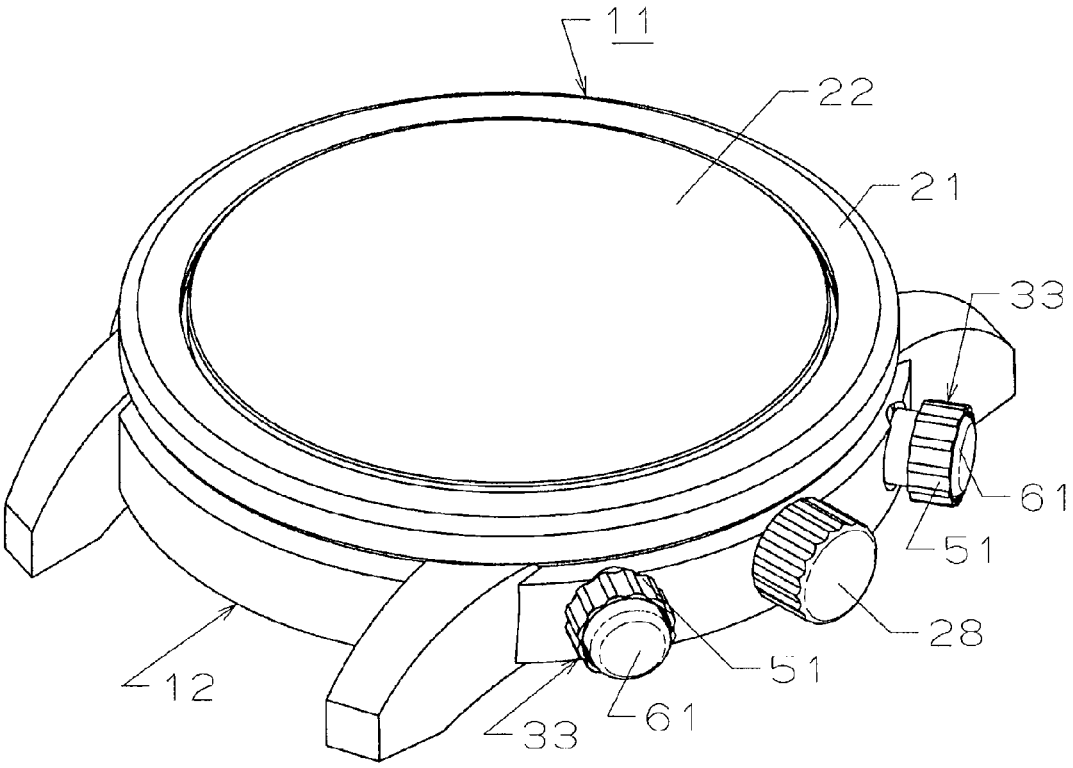

In FIGS. 4 and 5, numerals 25 and 26 indicate gaskets for maintaining the liquid-tightness of the timepiece exterior body 12. In FIGS. 1 through 3, numeral 28 indicates a crown.

Next, the construction for arranging pushbutton devices 33 described below at predetermined positions on the timepiece exterior body 12, e.g., at two positions of the body 21 constituting the side wall of this timepiece exterior body 12, will be described. The two pushbutton devices 33 and the constructions for arranging them on the timepiece exterior body 12 are the same, so that, here, the construction for arranging the pushbutton device 33 serving to light and extinguish the lamp for illuminating the dial 13 on the body 21 will be described with reference to FIGS. 4 and 5.

The body 21 has a recess 31 and a through-hole 32. As shown in FIG. 5, the recess 31 is open in the body external surface (exterior body outer side surface) 21*a* of the body 21. One end of the through-hole 32 is open to a bottom surface 31*a* of the recess 31, and the other end of the through-hole 32 is open to the inner surface of the timepiece exterior body 12, e.g., the body internal surface (exterior body inner side surface) 21*b*. The recess 31 and the through-hole 32, which is of a smaller diameter than this, are both circular, and are provided coaxially.

Figure 6:
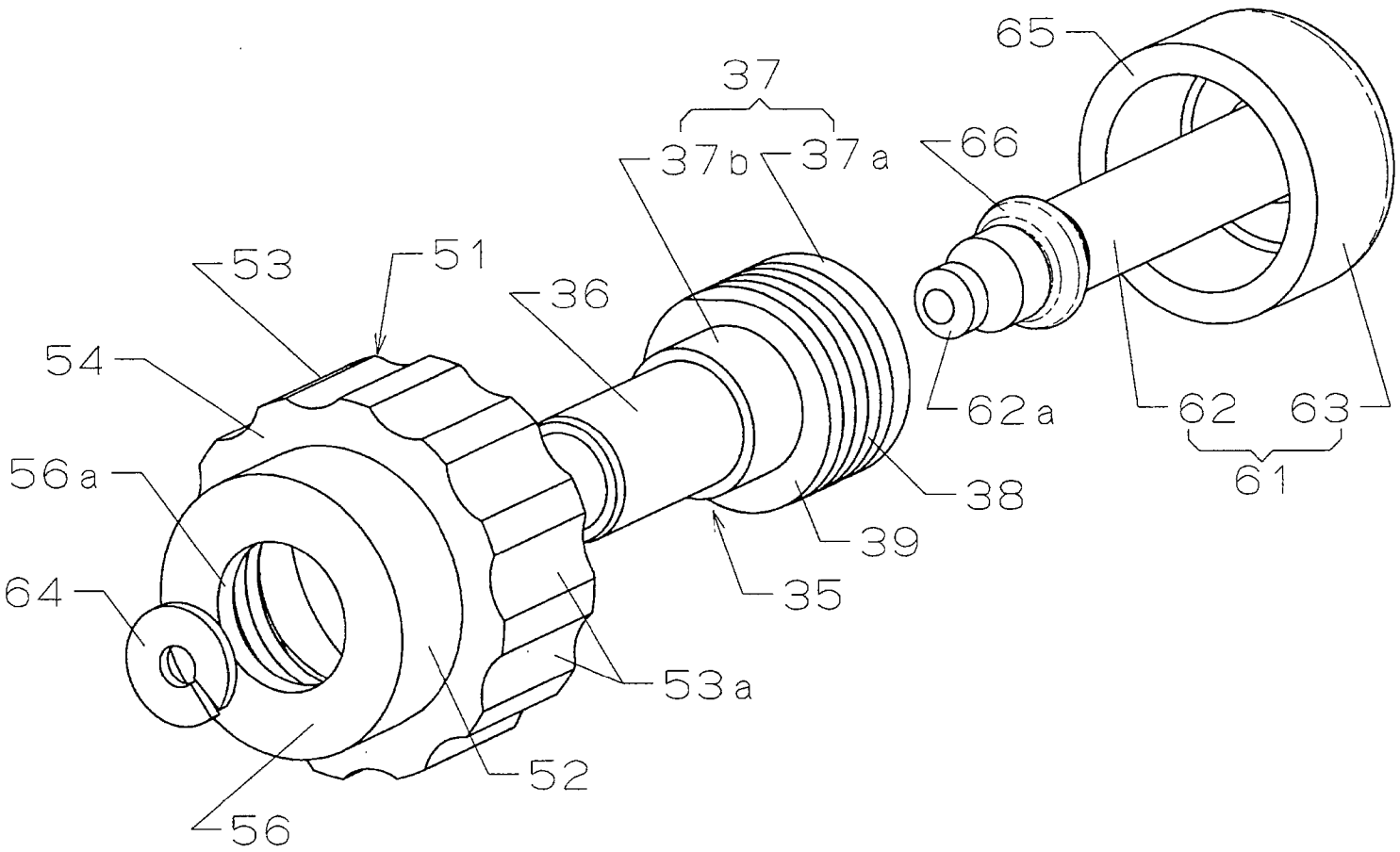
FIG. 6 is an exploded perspective view of a pushbutton device with which the wristwatch of FIG. 1 is provided.

Next, the pushbutton device 33 will be described with reference to FIGS. 4 through 6. The pushbutton device 33 is equipped with a pipe 35, a lock member 51, a pushbutton 61, a retaining ring 64, and a spring 71.

The pipe 35 consists of a single component formed of a metal such as stainless steel or titanium; it is of a cylindrical configuration, and is equipped with an insertion tube portion 36 and an external arrangement tube portion 37 integral therewith. The material of the pipe 35 is not restricted to metal; it may also be formed of synthetic resin.

The insertion tube portion 36 is a straight pipe forced, e.g., into the through-hole 32; the distal end portion thereof may be reduced in diameter.

The external arrangement tube portion 37 has a large-diameter tube portion 37*a* and a small-diameter tube portion 37*b*. The insertion tube portion 36 and the large-diameter tube portion 37*a* are integrally continuous via the small-diameter tube portion 37*b*. The small-diameter tube portion 37*b* is of a smaller diameter than the large-diameter tube portion 37*a*. As a result, the small-diameter tube portion 37*b* and the large-diameter tube portion 37*a* are integrally continuous via a step. It is desirable for the small-diameter tube portion 37*b* to be of a larger diameter than the outer diameter of the insertion tube portion 36. As a result, the insertion tube portion 36 and the small-diameter tube portion 37*b* are integrally continuous with each other via a step portion.

The external arrangement tube portion 37 has a male screw portion 38 and a stopper portion 39 integral therewith. More specifically, the male screw portion 38 is formed on the large-diameter tube portion 37*a* and over, for example, the entire outer periphery of this portion. This male screw portion 38 is provided so as to cause a lock member 51 described below to advance and retreat in the axial direction. The stopper portion 39 is formed by a step between the large-diameter tube portion 37*a* and a small-diameter tube portion 37*b*. This stopper portion 39 is continuous with one end of the male screw portion 38.

The large-diameter tube portion 37*a* has a spring receiving groove 40. The spring receiving groove 40 is open in the end surface of the large-diameter tube portion 37*a*, that is, in the end surface on the side opposite the step forming the stopper portion 39.

The pipe 35 is inserted into and fixed to the body 21. That is, the insertion tube portion 36 of the pipe 35 is forced in from the outer side of the body 21 to be thereby inserted into the through-hole 32. In this case, the insertion tube portion 36 is inserted until the step portion formed by the small-diameter tube portion 37*b* and the insertion tube portion 36 comes into contact with the bottom surface 31*a* of the recess 31. The insertion of the pipe 35 into the through-hole 32 is effected in a state in which the lock member 51 has been previously threadedly engaged with the external arrangement tube portion 37.

The pipe 35 is fixed to the body 21. For this fixation, there is used a brazing material 34 consisting, for example, of metal. The brazing material 34 is accommodated in an annular groove formed at a corner portion formed by the bottom surface 31*a* of the recess 31 and the through-hole 32. The brazing material 34 is covered from the outside of the body at the step portion of the pipe 35.

The distal end portion of the insertion tube portion 36 fixed as described above protrudes into the interior of the body 21. In this way, the external arrangement tube portion 37 of the pipe 35 fixed to the timepiece exterior body 12 is arranged outside the body 21, i.e., outside the timepiece exterior body 12.

The lock member 51 covering the external arrangement tube portion 37 is mounted thereto so as to be movable in the axial direction of the pipe 35.

More specifically, the lock member 51 is formed of a metal ring of a stepped configuration. This lock member 51 is equipped with a small-diameter tube portion 52, a large-diameter tube portion 53, a lock part 54, a female screw portion 55, and a lock portion 56.

The outer diameter of the small-diameter tube portion 52 is smaller than the diameter of the recess 31. The female screw portion 55 is formed on the inner surface of this small-diameter tube portion 52. The inner and outer diameters of the large-diameter tube portion 53 are larger than the diameter of the recess 31 and the diameter of the external arrangement tube portion 37. A plurality of grooves 53*a* (See FIG. 6) for preventing slipping of the fingers when manually operating the lock member 51 are formed in the outer periphery of the large-diameter tube portion 53 so as to be parallel to the axial direction of the lock member 51.

The lock part 54 is a wall extending in a direction orthogonal to the axial direction of the lock member 51; this lock part 54 extends between the small-diameter tube portion 52 and the large-diameter tube portion 53 to connect them integrally with each other. A button pushing-in recess 51*a* is defined by the large-diameter tube portion 53 and the lock part 54, and the lock part 54 holds the bottom of this button pushing-in recess 51*a*. The inner diameter of the button pushing-in recess 51*a* is larger than the diameter of the female screw portion 55, and is somewhat larger than the outer diameter of a head 63 described below.

The lock portion 56 is formed by an end wall of the lock member 51. That is, the lock portion 56 is provided integrally and continuously at the end on the side opposite the lock part 54 of the small-diameter tube portion 52 so as to narrow the opening of this end. The diameter of a hole 56*a* formed at the center of this lock portion 56 is larger than the diameter of the small-diameter tube portion 37*b* and smaller than that of the large-diameter tube portion 37*a*.

The female screw portion 55 of the lock member 51 is threadedly engaged with the male screw portion 38 of the external arrangement tube portion 37, and the lock member 51 is mounted to the external arrangement tube portion 37 so as to be movable in the axial direction of the pipe 35, covering the external arrangement tube portion 37. In the state in which the lock member 51 is supported by the pipe 35, the lock portion 56 of this lock member 51 is arranged between the bottom surface 31*a* of the recess 31 and the stopper portion 39.

The pushbutton 61 is supported by the pipe 35. The pushbutton 61 consists of an integral molding of metal or synthetic resin, and is equipped with a shaft portion 62 and a head 63.

The shaft portion 62 is of a columnar configuration, and is longer than the axial length of the pipe 35. This shaft portion 62 extends through the pipe 35 in the axial direction, and a retaining ring 64 preventing detachment of the pushbutton 61 from the pipe 35 is mounted to the shaft end portion (distal end portion) of the shaft portion 62 protruding into the interior of the body 21. The retaining ring 64 is formed of metal and is of C-type or E-type; its size is large enough to cause it to be caught by the end surface of the insertion tube portion 36 protruding into the interior of the body 21.

The shaft portion 62 has an annular gasket accommodation groove continuous in the peripheral direction thereof. A gasket 66 is fit-engaged with this gasket accommodation groove and is mounted to the shaft portion 62. The gasket 66 is formed in a ring-like configuration of a rubber type or a plastic type material capable of elastic deformation. In the elastically deformed state, the gasket 66 is held in close contact with the inner peripheral surface of the pipe 35. Due to this gasket 66, sealing is effected between the pipe 35 and the shaft portion 62, making the interior of the body waterproof and dustproof.

The head 63 is provided integrally at the other shaft end of the shaft portion 62. The outer diameter of the head 63 is slightly smaller than the diameter of the button pushing-in recess 51*a*. This head 63 has an opposing portion 65. The opposing portion 65 is formed, for example, by the annular end surface on the back side of the head 63.

The shaft portion 62 of the pushbutton 61 is inserted into the pipe 35 from the outside of the body 21 and is passed therethrough; then, the retaining ring 64 is mounted to the shaft end portion of the shaft portion 62 protruding into the interior of the body 21, whereby the pushbutton 61 is mounted so as to be prevented from detachment from the pipe 35. With this mounting, the head 63 is fitted into the exterior of the timepiece exterior body 12 and into the interior of the pushbutton recess 51*a* to be arranged therein. At the same time, the opposing portion 65 is caused to face the lock part 54 of the lock member 51.

A spring such as a coil spring 71 is held between the external arrangement tube portion 37 and the head 63 in a compressed state. The external arrangement tube portion 37 side portion of the coil spring 71 is accommodated in a spring receiving groove 40. This coil spring 71 can be further compressed through pushing-in of the pushbutton 61.

Due to the spring force of this coil spring 71, the pushbutton 61 is urged toward the exterior of the timepiece exterior body 12 (more specifically, toward the outer side of the body 21). As a result, the retaining ring 64 is maintained in the state where it is caught by the end surface of the pipe 35 protruding into the interior of the timepiece exterior body 12.

Next, the procedures by which the pushbutton device 33 is assembled will be described.

First, the female screw portion 55 of the lock member 51 is threadedly engaged with the male screw portion 38 of the large-diameter tube portion 37*a* of the pipe 35 from the insertion tube portion 36 side of the pipe 35 to mount the lock member 51 to the pipe 35 such that the lock member 51 covers the external arrangement tube portion 37. After this, the brazing material 34 is accommodated in the annular groove formed at the corner portion formed by the bottom surface 31*a* of the recess 31 of the body 21 and the through-hole 32.

In this state, the insertion tube portion 36 of the pipe 35 is inserted into the through-hole 32 from the exterior of the body 21 until the step portion formed by the insertion tube portion 36 of the pipe 35 and the small-diameter tube portion 37*b* comes into contact with the bottom surface 31*a* of the recess 31. After this, the brazing material 34 is melted through heating, and then this brazing material 34 is solidified, thereby fixing the pipe 35 to the body 21.

Next, the gasket 66 is mounted to the shaft portion 62 of the pushbutton 61, and the coil spring 71 is fit-engaged with the shaft portion 62 so as to be wound around the same.

Finally, the pushbutton 61 in this state is mounted to the pipe 35. That is, the shaft portion 62 of the pushbutton 61 is inserted into the pipe 35 and passed through the same from the outside of the body 21. At the same time, the gasket 66 is compressed and brought into close contact with the inner peripheral surface of the pipe 35, and the coil spring 71 is compressed while being accommodated in the spring receiving groove 40 of the external arrangement tube portion 37. In the state in which the shaft portion 62 is thus passed through the pipe 35, the retaining ring 64 is mounted to the distal end portion of the shaft portion 62 protruding into the interior of the body 21 to thereby prevent detachment of the pushbutton 61.

To detach the pushbutton 61 when dismantling the wristwatch 11 for cleaning, the retaining ring 64 is detached, whereby it is possible to pull out the pushbutton 61 from the pipe 35 to the exterior of the body 21. Thus, it is possible to clean the male screw portion 39, and to replace the gasket 66 and the coil spring 71.

The pushbutton 61 of the wristwatch 11 described above is in a state in which it is urged by the coil spring 71 in a direction reverse to the pushing-in direction of this button. In this case, the retaining ring 64 is caught by the distal end portion of the insertion tube portion 36, whereby the pushbutton 61 is prevented from being detached.

The lock member 51 of this wristwatch 11 is rotated by the operator when allowing and prohibiting the pushing-in of the pushbutton 61.

When allowing the pushing-in of the pushbutton 61, the lock member 51 is rotated to be arranged at the non-lock position shown in FIGS. 2 and 4.

That is, the lock member 51 is rotated so as to reduce the mesh-engagement length of the male screw portion 38 and the female screw portion 55, whereby the lock member 51 is moved to the position (non-lock position) where the lock portion 56 at one end thereof is in contact with the bottom surface 31*a* of the recess 31 of the body 21.

The lock member 51 moved to the non-lock position is in a state in which it is set in position on the body 21 of the timepiece exterior body 12. In this state, the lock portion 56 of the lock member 51 is most spaced away from the stopper portion 39 of the pipe 35, and the lock part 54 of the lock member 51 is most spaced away from the opposing portion 65 of the head 63 of the pushbutton 61. Thus, it is possible to push in the pushbutton 61 in correspondence with the distance between the lock part 54 and the opposing portion 65.

In the state in which the lock member 51 has been moved to the non-lock position, when the pushbutton 61 is pushed in from the outside of the body 21 against the spring force of the coil spring 71, the distal end portion 62*a* of the shaft portion 62 depresses the contact 16 arranged close to and opposite the same. As a result, the movement 15 is operated such that the function allotted to the pushbutton 61 is exerted, and the lamp for illuminating, for example, the dial, is lighted. After this, as the depression of the pushbutton 61 is released, the pushbutton 61 is restored to the former state by the spring force of the coil spring 71, so that the lamp is extinguished.

When prohibiting inadvertent pushing-in of the pushbutton 61 during transportation, etc. of the wristwatch 11, the lock member 51 is rotated, and is arranged at the lock position shown in FIGS. 3 and 5.

That is, the lock member 51 is rotated such that the mesh-engagement length of the male screw portion 38 and the female screw portion 55 is elongated, whereby the lock member 51 is moved to a position (lock position) where the lock portion 56 thereof is spaced away from the bottom surface 31*a* of the recess 31 of the body 21 and is caught by the stopper portion 39 of the pipe 35. In this case, the lock member 51 is moved in the axial direction so as to protrude sidewise from the body 21. This movement of the lock member 51 is hindered by the lock portion 56 thereof coming into contact with the stopper portion 39 of the pipe 35, and it is impossible to further rotate the lock member 51.

In the state in which the lock member 51 is arranged at the lock position, the major portion of the head 63 of the pushbutton 61 is sunk in the button pushing-in recess 51*a* of the lock member 51, so that it is possible for the operator to know that the pushbutton 61 is in a condition in which it cannot be pushed in.

In the state in which the lock member 51 has been moved to the lock position, when the pushbutton 61 receives a pushing-in force, the opposing portion 65 of the head 63 and the lock part 54 of the lock member 51 are in contact with or in close proximity to each other. Thus, the lock part 54 serves as a stopper and hinders the pushbutton 61 from being pushed in.

That is, the pipe 35 is fixed to the body 21 of the timepiece exterior body 12 by brazing. As a result, in the state in which the lock member 51 has been moved to the lock position, it is possible to support the load applied to the lock part 54 (the pushing-in force of the pushbutton 61) by the body 21 via the pipe 35. Thus, it is possible to prevent the pushbutton 61 from being pushed in.

As described above, in the state in which the lock member 51 is arranged at the lock position, the lock portion 56 thereof is in contact with the stopper portion 39 of the pipe 35. As a result, it is possible to prevent the lock member 51 from being excessively rotated so as to elongate the mesh-engagement length of the male screw portion 38 and the female screw portion 55. As a result, despite the fact that the lock member 51 and the head 63 are in contact with each other, there is no fear of the pushbutton 61 being moved toward the exterior of the body 21.

Thus, there is no fear of the retaining ring 64 mounted to the shaft portion 62 being drawn into the pipe 35 while deformed. At the same time, there is no fear of the pushbutton 61 being inadvertently detached. Thus, it is possible to improve the reliability of the pushbutton device 33 of a waterproof watch such as a diver's watch.

In the above pushbutton device 33, the pipe 35 having the stopper portion 39 retaining the lock member 51 at the lock position is not a combination of a plurality of members but a single component. Thus, there is no need for the time and effort and the structure for attaching the stopper prepared separately from the pipe 35 to the pipe 35. As a result, the number of components and assembly man-hours of the pushbutton device 33 is small, and the construction is simplified; and, with that, it is possible to reduce the cost of the wristwatch 11 equipped with the pushbutton device 33.

As described above, in the wristwatch 11 of the first embodiment, it is possible, with a simple construction, to prevent an excessive load from being applied to the retaining ring 64 via the pushbutton 61; and, at the same time, it is possible to eliminate the fear of the retaining ring 64 from being deformed and drawn into the pipe 35.

Further, in the pushbutton device 33, the small-diameter tube portion 37*b* of the external arrangement tube portion 37 is of a larger diameter than the insertion tube portion 36 of the pipe 35, and the step portion formed by the small-diameter tube portion 37*b* and the insertion tube portion 36 is in contact with the bottom surface 31*a* of the recess 31 formed in the body 21 of the timepiece exterior body 12 so as to be open to the exterior of this body 21.

Due to this construction, the pipe 35 inserted into and fixed to the through-hole 32 of the body 21 can be set in position in the axial direction with respect to the timepiece exterior body 12. As a result, the stopper portion 39 of the pipe 35 and the large-diameter tube portion 37*a* having the male screw portion 38, are arranged at proper positions with respect to the bottom surface 31*a* of the recess 31. Thus, it is easy to control the stroke of the lock member 51 between the lock position and the non-lock position.

Figure 7:
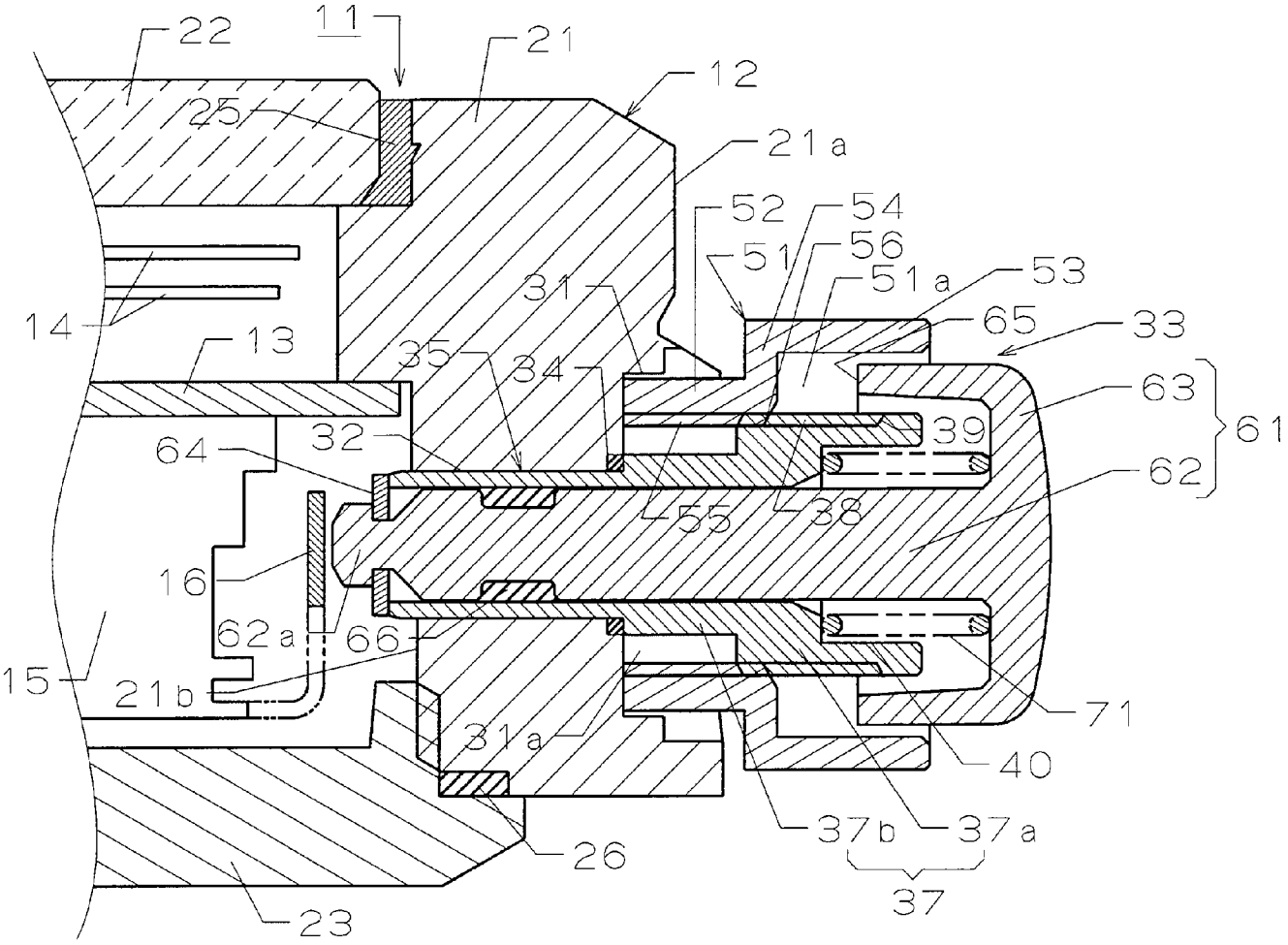
FIG. 7 is a sectional view, corresponding to FIG. 4, illustrating a wristwatch according to a second embodiment of the present invention.
Figure 8:
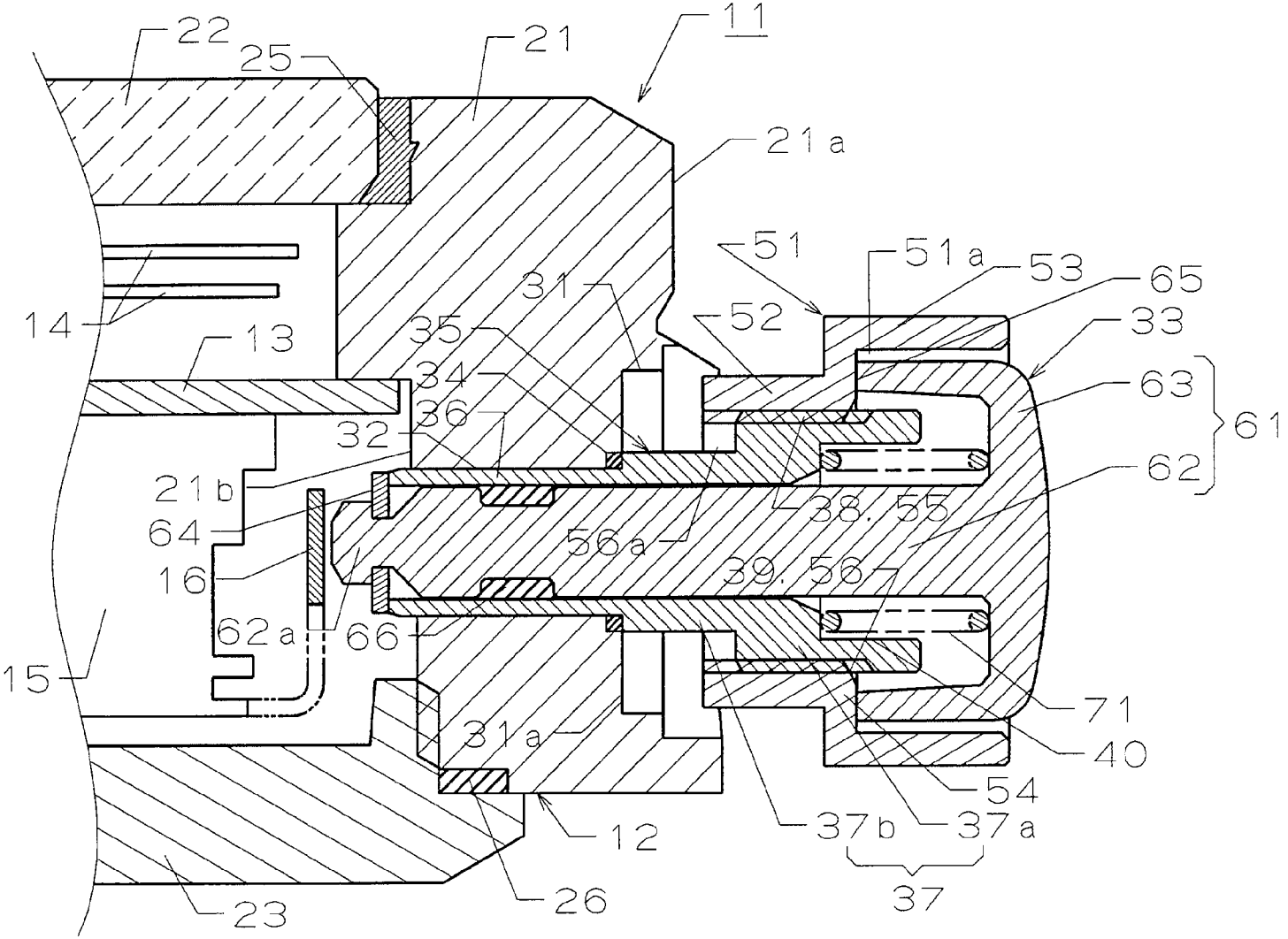
FIG. 8 is a sectional view, corresponding to FIG. 5, illustrating the wristwatch according to the second embodiment.
Figure 9:
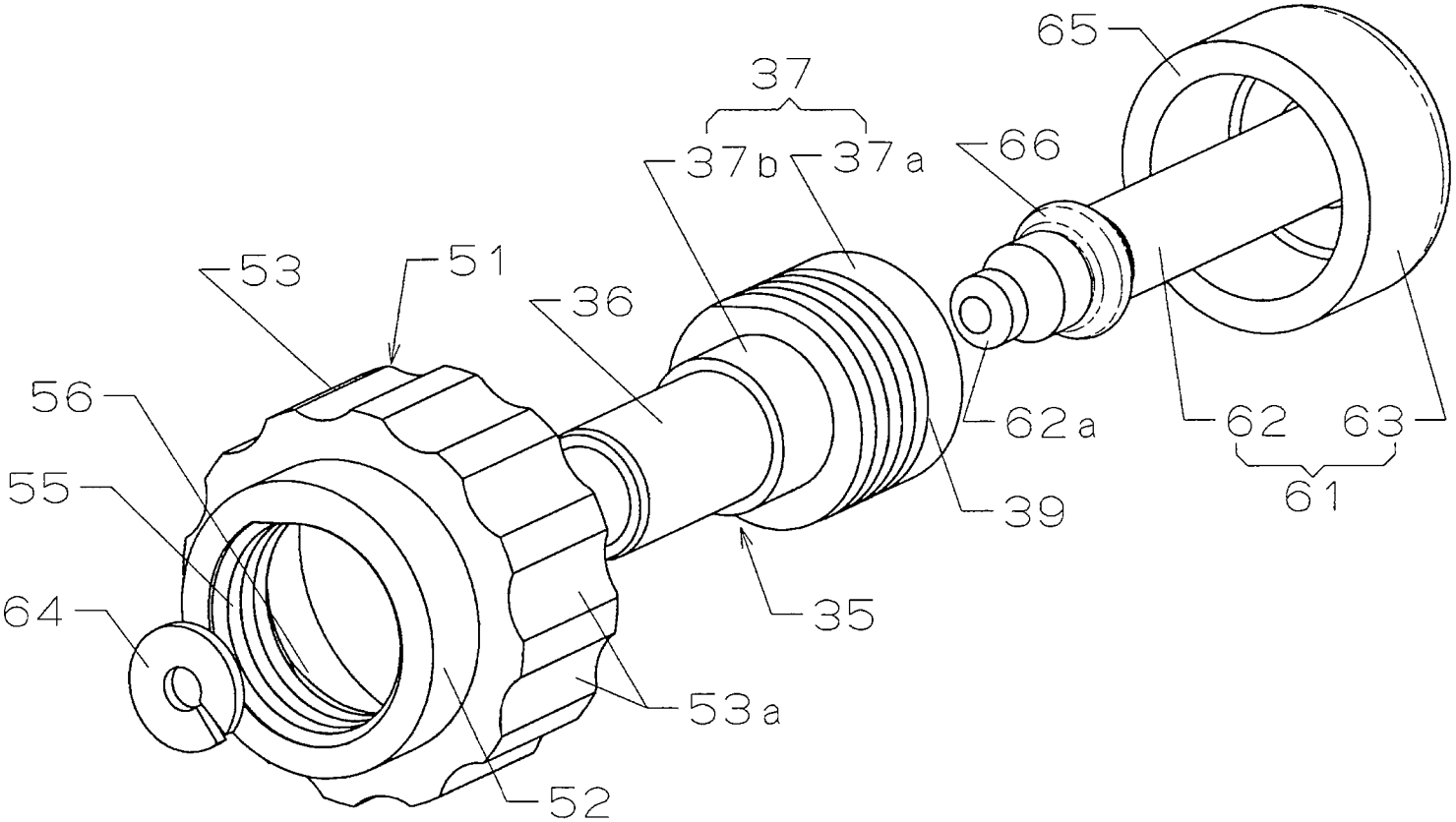
FIG. 9 is an exploded perspective view of a pushbutton device of a wristwatch according to the second embodiment.

FIGS. 7 through 9 illustrate the second embodiment of the present invention. Except for the following description, the construction of the second embodiment is the same as that of the first embodiment, so the components that are of the same construction and of the same function as those of the first embodiment are indicated by the same reference numerals, and a description thereof will be left out.

In the second embodiment, the length of the male screw portion 38 formed in the outer periphery of the large diameter tube portion 37*a* of the external arrangement tube portion 37 of the pipe 35 is shorter than the axial length of the large-diameter tube portion 37*a*. Thus, the male screw portion 38 has an incomplete screw portion. This incomplete screw portion is used as the stopper portion 39, and is provided at a position spaced away from the step formed by the large-diameter tube portion 37*a* and the small-diameter tube portion 37*b*.

Further, in the second embodiment, the small-diameter tube portion 52 of the lock member 51 is a straight pipe, and the end of this small-diameter tube portion 52 on the side opposite the large-diameter tube portion 53 is open, with the opening thereof being not narrowed. Thus, the female screw portion 55 is formed over the entire small-diameter tube portion 52 in the axial direction thereof. In the second embodiment, the lock portion 56 of the lock member 51 is formed by the end of the female screw portion 55 continuous with the lock part 54. Otherwise, this embodiment is the same as the first embodiment.

In the second embodiment, when allowing the pushing-in of the pushbutton 61, the lock member 51 is rotated, and is arranged at the non-lock position shown in FIG. 7.

That is, the lock member 51 is rotated such that the mesh-engagement length of the male screw portion 38 and the female screw portion 55 is shortened, whereby the lock member 51 is moved to a position (non-lock position) where the distal end of the small-diameter tube portion 52 is held in contact with the bottom surface 31*a* of the recess 31 of the body 21.

The lock member 51 moved to the non-lock position is set in position on the body 21 of the timepiece exterior body 12. In this state, the lock portion 56 of the lock member 51 is most spaced away from the stopper portion 39 consisting of the incomplete screw portion, and the lock part 54 of the lock member 51 is most spaced away from the opposing portion 65 of the head 63 of the pushbutton 61. As a result, the pushbutton 61 can be pushed in by a distance in correspondence with the distance between the lock part 54 and the opposing portion 65.

In the state in which the lock member 51 has been moved to the non-lock position, when the pushbutton 61 is pushed in from the outside of the body 21 against the spring force of the coil spring 71, the distal end portion 62*a* of the shaft portion 62 depresses the contact 16 arranged in close proximity to and opposite the same. As a result, the movement 15 is operated such that the function allotted to the pushbutton 61 is exerted, and the lamp for illuminating, for example, the dial, is lighted. After this, as the depression of the pushbutton 61 is released, the pushbutton 61 is pushed back to the former state by the spring force of the coil spring 71, so that the lamp is extinguished.

When prohibiting inadvertent pushing-in of the pushbutton 61 during transportation, etc. of the wristwatch 11, the lock member 51 is rotated, and is arranged at the lock position shown in FIG. 8.

That is, the lock member 51 is rotated such that the mesh-engagement length of the male screw portion 38 and the female screw portion 55 is elongated, whereby the small-diameter tube portion 52 of the lock member 51 is moved to a position (lock position) where the lock portion 56 thereof is spaced away from the bottom surface 31*a* of the recess 31 of the body 21 and where the end (lock portion 56) of the female screw portion 55 of the lock member 51 is in contact with the stopper portion 39 consisting of the incomplete screw portion of the male screw portion 38. In this case, the lock member 51 is moved in the axial direction so as to protrude sidewise from the body 21. This movement of the lock member 51 is hindered by the lock portion 56 thereof coming into contact with the stopper portion 39 of the pipe 35, and it is impossible to further rotate the lock member 51.

In the state in which the lock member 51 has been moved to the lock position, when the pushbutton 61 receives a pushing-in force, the opposing portion 65 of the head 63 and the lock part 54 of the lock member 51 are in contact with or in close proximity to each other. Thus, the lock part 54 serves as a stopper and hinders the pushbutton 61 from being pushed in.

That is, the pipe 35 is fixed to the body 21 of the timepiece exterior body 12 by brazing. As a result, in the state in which the lock member 51 has been moved to the lock position, it is possible to support the load applied to the lock part 54 (the pushing-in force of the pushbutton 61) by the body 21 via the pipe 35. Thus, it is possible to prevent the pushbutton 61 from being pushed in.

As described above, in the state in which the lock member 51 is arranged at the lock position, the lock portion 56 thereof is in contact with the stopper portion 39 of the pipe 35. As a result, it is possible to prevent the lock member 51 from being excessively rotated so as to elongate the mesh-engagement length of the male screw portion 38 and the female screw portion 55. As a result, despite the fact that the lock member 51 and the head 63 are in contact with each other, there is no fear of the pushbutton 61 being moved toward the exterior of the body 21.

Thus, there is no fear of the retaining ring 64 mounted to the shaft portion 62 being drawn into the pipe 35 while deformed. At the same time, there is no fear of the pushbutton 61 being inadvertently detached. Thus, it is possible to improve the reliability of the pushbutton device 33 of a waterproof watch such as a diver's watch.

In the above pushbutton device 33, the pipe 35 having the stopper portion 39 retaining the lock member 51 at the lock position is not a combination of a plurality of members but a single component. Thus, there is no need for the time and effort and the structure for attaching the stopper prepared separately prepared from the pipe 35 to the pipe 35. As a result, the number of components and assembly man-hours of the pushbutton device 33 is small, and the construction is simplified; and, with that, it is possible to reduce the cost of the wristwatch 11 equipped with the pushbutton device 33.

As described above, in the wristwatch 11 of the first embodiment, it is possible, with a simple construction, to prevent an excessive load from being applied to the retaining ring 64 via the pushbutton 61; and, at the same time, it is possible to eliminate the fear of the retaining ring 64 from being deformed and drawn into the pipe 35.

Furthermore, the configuration of the lock member 51 used in the second embodiment is simpler than the configuration of the lock member 51 used in the first embodiment; in addition, it is easy to machine the female screw portion 55 with respect to the small-diameter tube portion 52. As a result, it is possible to reduce the cost of the lock member 51.

Figure 10:
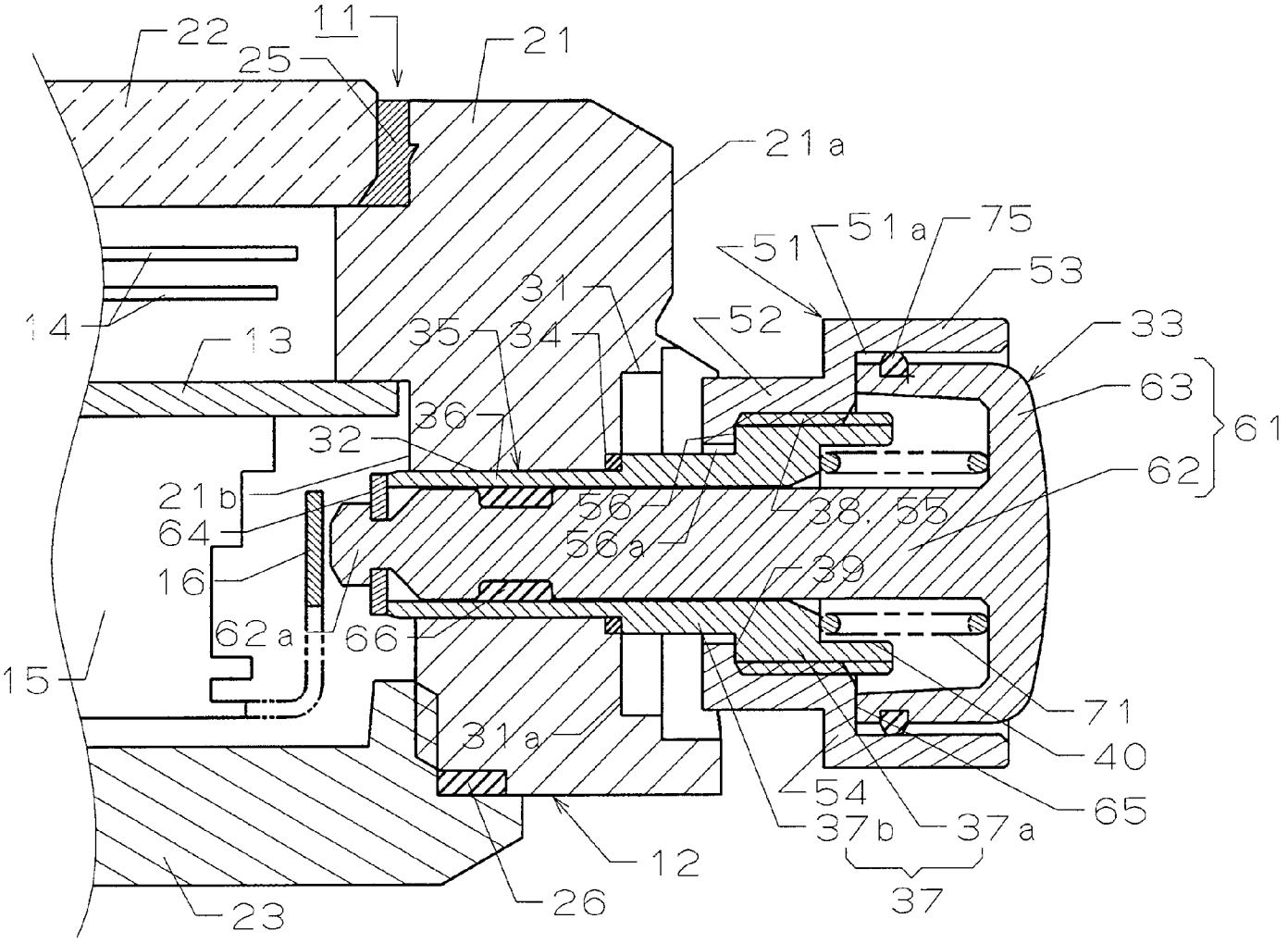
FIG. 10 is a sectional view, corresponding to FIG. 5, illustrating a wristwatch according to a third embodiment of the present invention.

FIG. 10 shows the third embodiment of the present invention. Except from the following description, the third embodiment is of the same construction as the first embodiment, so the components that are of the same construction and of the same function as those of the first embodiment are indicated by the same reference numerals, and a description thereof will be left out.

In the third embodiment, the diameter (out diameter) of the small-diameter tube portion 37*b* of the external arrangement tube portion 37 is the same as the outer diameter of the insertion tube portion 36.

Further, in the third embodiment, a seal ring 75 is provided between the large-diameter tube portion 53 of the lock member 51 and the head 63 of the pushbutton 61. Thus, there is provided, for example, at the distal end portion of the annular wall portion of the head 63, an annular groove open to the outer periphery thereof. The seal ring 75 is fit-engaged with this annular groove, whereby the seal ring 75 is mounted to the outer periphery of the head 63. The seal ring 75 is formed of a rubber type or a plastic type material capable of elastic deformation. The seal ring 75 is held in close contact with the inner peripheral surface of the large-diameter tube portion 53 of the lock member 51. Sealing is effected by this seal ring 75 between the large-diameter tube portion 53 of the lock member 51 and the head 63 of the pushbutton 61.

Otherwise, this embodiment is of the same construction as the first embodiment. Thus, for the same reason as given with regard to the first embodiment, also in the third embodiment, it is possible, with a simple construction, to prevent an overload from being applied to the retaining ring 64 via the push button 61; at the same time, it is possible to eliminate the fear of the retaining ring 64 being deformed to be drawn into the pipe 35.

In addition, in the third embodiment, when the operator rotates the lock member 51 and when he performs pushing-in operation on the pushbutton 61, it is possible to provide the operator with an adequate operational feel due to the sliding resistance of the seal ring 75; furthermore, it is possible to suppress in advertent rotation in the loosening direction of the lock member 51 arranged at the lock position, so that the lock member 51 is maintained at the lock position with high reliability. At the same time, this embodiment is superior to the first embodiment in that it is possible, due to the seal ring 75, to suppress the intrusion of foreign matter such as grain of sands through the gap between the large-diameter tube portion 53 of the lock member 51 and the outer periphery of the head 63.

What is claimed is:

1. A portable apparatus comprising:

an apparatus exterior body having a through-hole;

a pipe formed of a single component that comprises (i) an insertion tube portion inserted in the through-hole in fixed attachment to the apparatus exterior body, (ii) an external arrangement tube portion extensive from the insertion body to outside the apparatus exterior body, the external arrangement tube portion comprising a stopper portion, and (iii) a male screw portion formed on an outer peripheral surface of the external arrangement tube portion;

a lock member arranged around the outer peripheral surface of the external arrangement tube portion of the pipe, the lock member comprising (i) a female screw portion meshed with the male screw formed on the external arrangement tube portion of the pipe, wherein the lock member is movable relative to the external arrangement tube portion of the pipe toward or away from the apparatus exterior body by means of the meshed male and female screw portions with a rotation of the lock member around the external arrangement tube portion of the pipe, (ii) a lock part, and (iii) a lock portion movable toward and away from the stopper portion with a movement of the lock member relative to the external arrangement tube portion of the pipe, wherein the lock portion of the lock member is configured to engage with the stopper portion of the pipe to thereby define an outward limit to movement of the lock member away from the apparatus exterior body;

a pushbutton comprising (i) a shaft portion slidably inserted in the pipe, and (ii) a head situated outside the apparatus exterior body and pushable to move, along with the shaft portion, toward the apparatus exterior body, the head having an opposing portion configured to rest on the lock part of the lock member positioned at the outward limit to thereby restrict movement of the pushbutton toward the apparatus exterior body;

a spring urging the pushbutton away from the apparatus exterior body; and a retaining ring mounted to a shaft end portion of the shaft portion of the pushbutton and configured to engage with the insertion tube portion of the pipe to prevent detachment of the pushbutton from the pipe.

2. The portable apparatus according to claim 1, wherein the external arrangement tube portion of the pipe comprises (i) a large-diameter tube portion formed with the male screw portion in its outer peripheral surface, and (ii) a small-diameter tube portion extensive between the insertion tube portion and the large-diameter tube portion, connection between the large-diameter tube portion and small-diameter tube portion of the pipe forms a step which functions as the stopper portion of the pipe, and the lock member further comprises an inner flange extensive toward the small-diameter tube portion of the pipe, wherein the inner flange functions as the lock portion of the lock member and is engageable with the step of the pipe to thereby define the outward limit to movement of the lock member away from the apparatus exterior body.

3. The portable apparatus according to claim 1, wherein the male screw portion formed on the external arrangement tube portion has an outward end which terminates within the outer peripheral surface of the external arrangement tube portion, the outward end of the mail screw portion functions as the stopper portion of the pipe, and the female screw portion of the lock member has an outward end which functions as the lock portion and is engageable with the outward end of the male screw portion to thereby define the outward limit to movement of the lock member away from the apparatus exterior body.

4. The portable apparatus according to claim 2, wherein the small-diameter tube portion of the pipe is larger in diameter than the insertion tube portion of the pipe, and connection between the small-diameter tube portion and insertion tube portion of the pipe forms a step held in contact with the apparatus exterior body.

5. The portable apparatus according to claim 1, wherein the lock member comprises (i) a small cylindrical portion formed with the female screw portion in its inner peripheral surface, and (ii) a large-cylindrical portion having a larger diameter than that of the small-cylindrical portion, wherein the head of the pushbutton is movable inside the large-cylindrical portion, connection between the small and large-cylindrical portions of the lock member forms a step an inner surface of which functions as the lock part, and the head comprises an inward end which functions as the opposing portion positionable on the lock part of the lock member positioned at the outward limit to thereby restrict movement of the pushbutton toward the apparatus exterior body.

6. A portable timepiece formed by a portable apparatus according to claim 1.

7. The portable apparatus according to claim 5, further comprising a seal ring provided between an inner peripheral surface of the large-cylindrical portion of the lock member and an outer peripheral surface of the head of the pushbutton to seal therebetween.

8. The portable apparatus according to claim 1, wherein the lock member is movable toward the apparatus exterior body until the lock member becomes in contact with the apparatus exterior body to thereby define an inward limit to movement of the lock member toward the apparatus exterior body.

* * * * *